US006578234B2

(12) United States Patent
Westerdale

(10) Patent No.: US 6,578,234 B2
(45) Date of Patent: Jun. 17, 2003

(54) FOUR BAR HINGE FOR VEHICLE REAR DECK LID

(75) Inventor: David L. Westerdale, Monroe, MI (US)

(73) Assignee: Midway Products Group, Inc., Monroe, MI (US)

( * ) Notice: Subject to any disclaimer, the term of this patent is extended or adjusted under 35 U.S.C. 154(b) by 0 days.

(21) Appl. No.: 09/962,760

(22) Filed: Sep. 25, 2001

(65) Prior Publication Data

US 2003/0056330 A1 Mar. 27, 2003

(51) Int. Cl.[7] ..... E05D 15/32

(52) U.S. Cl. ..... 16/370; 16/369; 16/368; 16/239

(58) Field of Search ..... 16/370, 369, 368, 16/362, 242, 245, 246, 239, 76

(56) References Cited

U.S. PATENT DOCUMENTS

| | | | | | |
|---|---|---|---|---|---|
| 2,185,214 | A | * | 1/1940 | Claud-Mantle | 16/288 |
| 3,153,257 | A | * | 10/1964 | Daenzer | 16/302 |
| 4,012,807 | A | * | 3/1977 | Kern | 16/288 |
| 4,382,312 | A | * | 5/1983 | Liggett et al. | 16/288 |
| 4,727,621 | A | * | 3/1988 | Emery et al. | 16/239 |
| 4,776,061 | A | | 10/1988 | Franco | |
| 4,893,863 | A | * | 1/1990 | Skonieczny et al. | 16/235 |
| 5,008,977 | A | * | 4/1991 | Lautenschlager et al. | 16/278 |
| 5,029,930 | A | | 7/1991 | Ihrke et al. | |
| 5,158,333 | A | | 10/1992 | Saville | |
| 5,557,829 | A | | 9/1996 | Schoen et al. | |
| 5,669,105 | A | * | 9/1997 | Depke | 16/244 |
| 5,755,011 | A | | 5/1998 | Green et al. | |
| 5,873,619 | A | | 2/1999 | Lewkoski et al. | |
| 5,895,089 | A | * | 4/1999 | Singh et al. | 16/86 B |
| 5,967,586 | A | | 10/1999 | Duffy et al. | |
| 6,248,172 | B1 | * | 6/2001 | Shirotani et al. | 118/500 |
| 6,276,025 | B1 | * | 8/2001 | Leibman | 16/240 |
| 2001/0039762 | A1 | * | 11/2001 | Giovannetti | 49/246 |

* cited by examiner

*Primary Examiner*—Gary Estremsky
*Assistant Examiner*—Mark Williams
(74) *Attorney, Agent, or Firm*—Brooks & Kushman P.C.

(57) ABSTRACT

A four bar hinge (24) for mounting a vehicle rear deck lid (26) for movement between open and closed positions includes first and second vehicle body and deck lid mounted hinge members (28, 32) one of which has an adjuster (38), and the hinge also includes first and second connection members (42, 52) that extend between the hinge members with pivotal connections to provide a four bar linkage (62) that supports the deck lid for movement between open and closed positions. An adjuster member (40) of the adjuster (38) is adjustable upon assembly to move the deck lid vertically so as to be flush with the rear deck outer skin (16) of the vehicle. This adjustment is provided by a threaded connection (70).

12 Claims, 4 Drawing Sheets

FOUR BAR HINGE FOR VEHICLE REAR DECK LID

BACKGROUND OF THE INVENTION

1. Field of the Invention

This invention relates to a four bar hinge utilized to mount a vehicle rear deck lid on a vehicle body for movement between open and closed positions with respect to a generally upwardly oriented rear trunk opening that is defined in a generally horizontally extending rear outer skin of the vehicle body.

2. Background Art

Vehicle body rear trunk openings are conventionally opened and closed by rear deck lids that are mounted by hinges for movement between open and closed positions. One type of hinge that is utilized to support deck lids for movement between the open and closed positions is a gooseneck hinge such as disclosed by U.S. Pat. No. 5,029,930 Ihrke et al., U.S. Pat. No. 5,158,333 Saville, and U.S. Pat. No. 5,873,619 Lewkowski et al. Such gooseneck hinges have previously included threaded adjusters for adjusting the position of the deck lid in the closed position so as to be flush with the generally horizontally extending rear deck outer skin of the vehicle body so that there is no abrupt discontinuity at the junction between the deck lid and the rear deck outer skin.

Vehicle rear deck lids have also been mounted by four bar hinges that include a pair of hinge members for respectively mounting on the vehicle body and on the deck lid with a pair of connection members having opposite ends respectively pivotally connected to the pair of hinge members to provide a four bar linkage that controls the opening and closing deck lid movement. One type of such four bar hinge as disclosed by U.S. Pat. No. 5,557,829 Schoen et al. has one hinge member constructed with a vertical orientation having vertical slots that receive vehicle mounted threaded fasteners so that upward and downward movement and subsequent fastener tightening permits hinge adjustment for maintaining the deck lid flush with the rear deck outer skin in the closed position. Another type of four bar hinge has the vehicle body hinge member provided with a horizontal construction that is mounted on a generally horizontally extending vehicle body member and secured by fasteners with shims providing the proper elevation so as to maintain a flush condition of the deck lid with the rear deck outer skin of the vehicle body.

Other hinges noted during an investigation conducted for the present invention are disclosed by U.S. Pat. No. 4,776,061 Franco and U.S. Pat. No. 5,755,011 Green et al.

SUMMARY OF THE INVENTION

An object of the present invention is to provide an improved four bar hinge for mounting a vehicle rear deck lid on a vehicle body for movement between open and closed positions with respect to a generally upwardly oriented rear trunk opening defined in a generally horizontally extending rear deck outer skin of the vehicle body.

In carrying out the above object, the four bar hinge of the invention includes a first hinge member for mounting on the vehicle body and a second hinge member for mounting on the deck lid. One of the hinge members includes an adjuster having an adjuster member that has a pivotal connection to the one hinge member, and the adjuster includes a threaded connection that extends between the adjuster member and the one hinge member to adjustably move the adjuster member vertically. A first connection member of the hinge has opposite ends including respective pivotal connections to the first and second hinge members. A second connection member of the hinge has opposite ends one of which has a pivotal connection to the adjuster member of the one hinge member and the other of which has a pivotal connection to the other hinge member to cooperate with the first connection member and the first and second hinge members in providing a four bar linkage that supports the deck lid for movement between the open and closed positions. The adjuster member of the adjuster is adjustable vertically by the threaded connection upon assembly to move the deck lid vertically so as to be flush with the rear deck outer skin.

In the preferred construction of the vehicle rear deck lid four bar hinge, the one hinge member including the adjuster is the first hinge member that is mounted on the vehicle body. The adjuster member includes a first end where the pivotal connection of the adjuster member mounts the adjuster member on the vehicle body mounted first hinge member, and the adjuster member has a second end at which the one end of the second connection member has its pivotal connection to the adjuster member. The threaded connection of the adjuster extends between the first hinge member and the adjuster member at a location between the ends thereof to vertically position the adjuster member.

In the preferred construction, the adjuster member extends forwardly with respect to the vehicle body from its first pivotally mounted end to its second end that is pivotally connected to the second connection member. The adjuster member includes a vertically extending flange that defines the first and second ends, and the adjuster includes a horizontally extending flange that extends from the vertically extending flange and at which the threaded connection is connected to the adjuster member between its first and second ends.

The threaded connection of the adjuster includes a threaded stud that projects upwardly from the first hinge member and also includes a threaded nut that is rotatable on the horizontally extending flange of the adjuster member. The threaded nut threadingly receives the threaded stud such that nut rotation vertically adjusts the adjuster member and the deck lid.

In the preferred construction, the first hinge member as mentioned above is the one having the adjuster and includes a horizontal flange for mounting thereof on the vehicle body as well as including a vertical flange. The pivotal connection of the first connection member to the first hinge member is at the vertical flange of the first hinge member, and the adjuster member includes a pivotal connection to the vertical flange of the first hinge member. The second hinge member includes a horizontal flange for mounting the deck lid as well as including a vertical flange at which the first and second connection members have their pivotal connections to the second hinge member.

The adjuster member as mentioned above includes a horizontal flange and a vertical flange that extends downwardly from the horizontal flange. The pivotal connection of the adjuster member to the vertical flange of the first hinge member is at the vertical flange of the adjuster member, and the previously mentioned threaded connection extends between the horizontal flange of the first hinge member and the horizontal flange of the adjuster member to provide threaded adjusting of the adjuster member so as to move the deck lid flush with the rear deck outer skin. Furthermore, the vertical flange of the adjuster member has opposite ends at which are respectively located the pivotal connection to the vertical flange of the first hinge member and the pivotal connection to the second connection member.

The objects, features and advantages of the present invention are readily apparent from the following detailed description of the preferred embodiment when taken in connection with the accompanying drawings.

DETAILED DESCRIPTION OF THE PREFERRED EMBODIMENT

Figure 1:
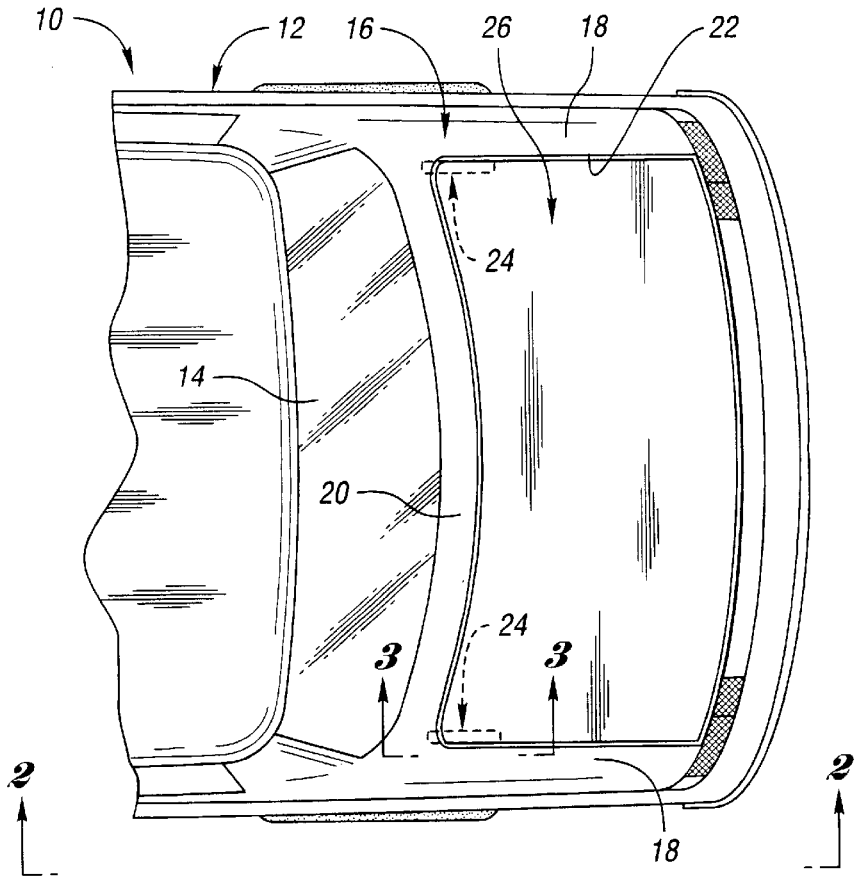
FIG. 1 is a partial top plan view of the rear end of a vehicle illustrating a deck lid that is mounted on the associated vehicle body by a pair of four bar hinges each of which is constructed in accordance with the present invention.
Figure 2:
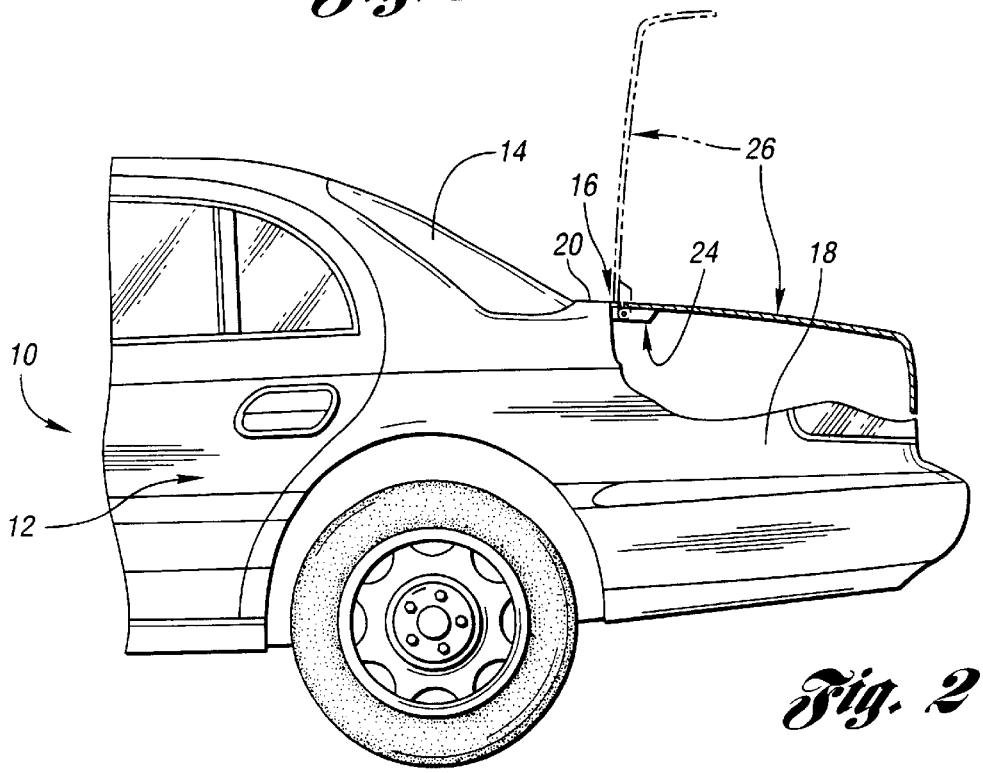
FIG. 2 is a partial side view of the vehicle rear end taken along the direction of line 2—2 in FIG. 1 and illustrates the manner in which the four bar hinges mount the deck lid for movement between its solid line indicated closed position with respect to an associated trunk opening and a phantom line indicated open position.

With reference to FIGS. 1 and 2, a partially illustrated vehicle generally indicated by 10 includes a vehicle body 12 whose rear end behind the rear window 14 includes a generally horizontally extending rear deck outer skin 16 defined by rear quarter panels 18 and a rear deck panel 20 that extends laterally between the rear quarter panels at the rear lower extremity of the rear window 14. The rear deck outer skin 16 defines a generally upwardly oriented rear trunk opening 22. A pair of four bar hinges 24 that are each constructed in accordance with the invention cooperate to mount a rear deck lid 26 for movement between the solid line indicated closed position shown in FIG. 2 and the phantom line indicated open position with respect to the trunk opening.

Figure 3:
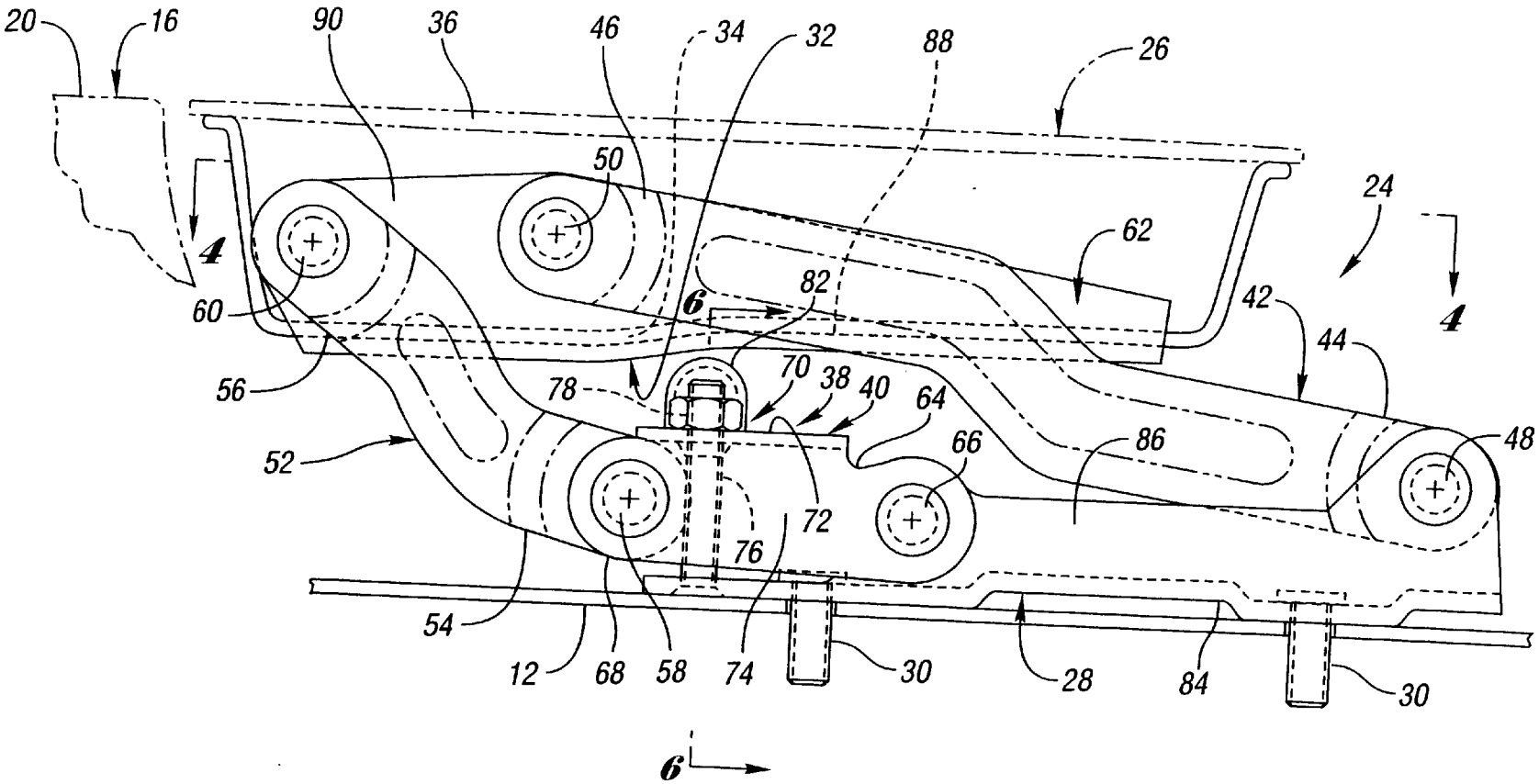
FIG. 3 is an elevational view taken along the direction of line 3—3 in FIG. 1 to illustrate the construction of the four bar hinge of the invention with the hinge shown in its closed position.

With reference to FIGS. 2–5, the four bar hinge 24 of the invention includes a first hinge member 28 for mounting on the vehicle body 12 with securement being provided by a pair of threaded stud fasteners 30. A second hinge member 32 of the four bar hinge 24 is mounted on the deck lid 26 at an inner mounting member 34 thereof on which an outer panel 36 of the deck lid is supported. This deck lid mounting is provided by suitable fasteners 37 shown in section in FIG. 4. One of the hinge members, which is the vehicle body mounted hinge member 28 as illustrated, includes an adjuster 38 having an adjuster member 40 that is adjustably movable vertically. A first connection member 42 of the four bar hinge has opposite ends 44 and 46 including respective pivotal connections 48 and 50 to the first and second hinge members 28 and 32. A second connection member 52 of the four bar hinge has opposite ends 54 and 56, with the end 54 having a pivotal connection 58 to the adjuster member 40 of the first hinge member 28, and with the end 56 having a pivotal connection 60 to the second hinge member 32 at a location forward from the pivotal connection 50 thereto of the first connection member 42. The first and second connection members 42 and 52 cooperate with the first and second hinge members 28 and 32 in providing a four bar linkage collectively indicated by 62 for supporting the deck lid 26 for movement between the open position illustrated in FIG. 5 and the closed position illustrated in FIG. 3. Upon assembly of the four bar hinge 24 as illustrated in FIG. 3, the adjuster member 40 is adjustable to move the rear deck lid 26 vertically so as to be flush with the rear deck outer skin 16.

As previously mentioned, the one hinge member including the adjuster 38 is the vehicle body mounted first hinge member 28. Although it is also possible to provide the adjuster 38 as part of the deck lid mounted second hinge member 32, the incorporation of the adjuster into the vehicle body mounted hinge member 28 is preferred because it is readily accessible upon deck lid opening to provide the adjustment and provides a visual indication of the extent of vertical adjustment with the deck lid in its open position.

Figure 4:
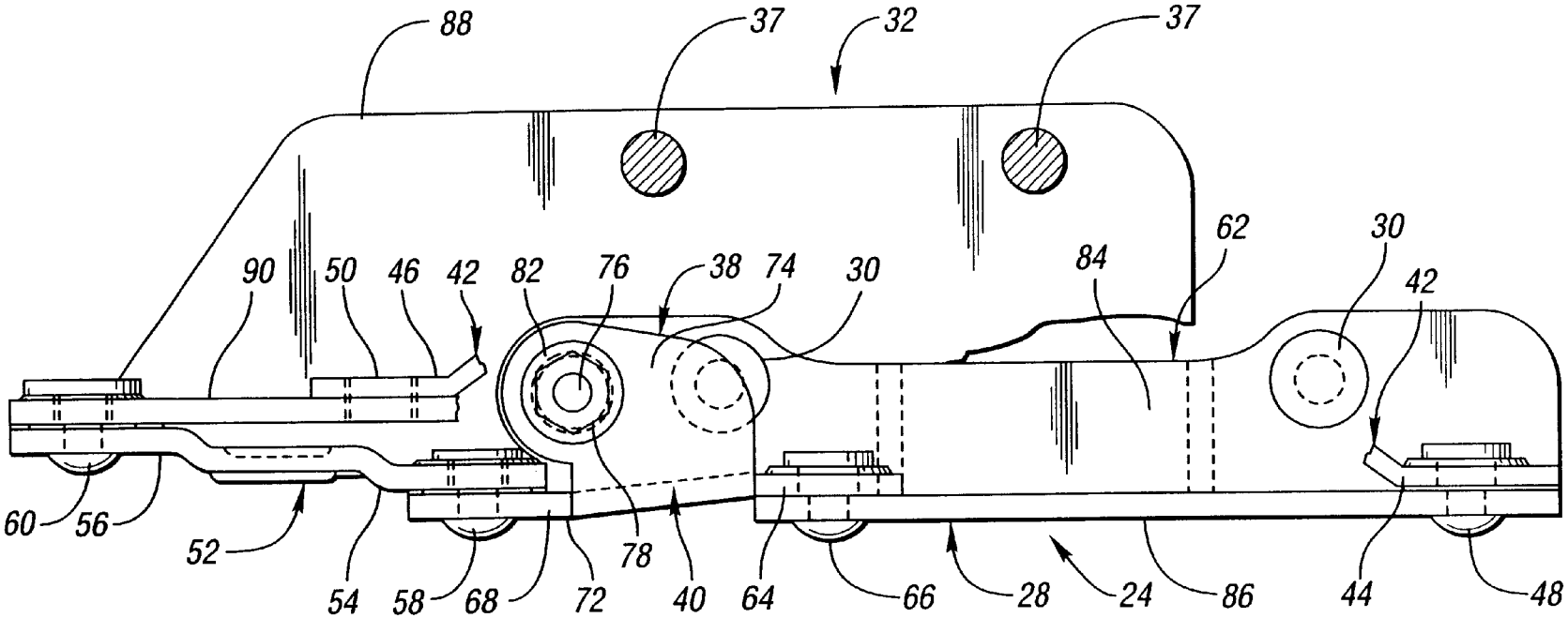
FIG. 4 is a partially broken away top plan view taken along the direction of line 4—4 in FIG. 3 to further illustrate the four bar hinge of the invention.
Figure 5:
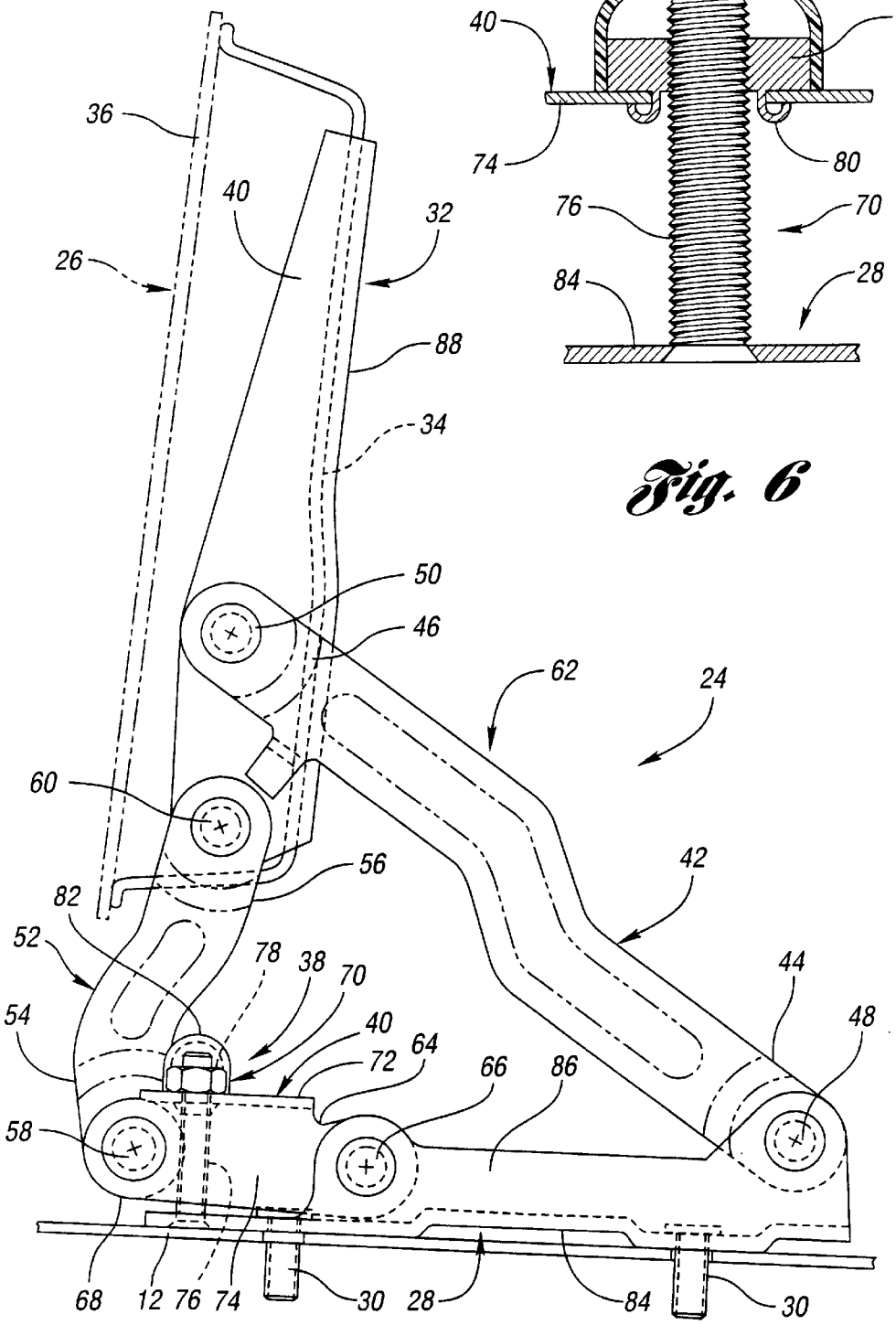
FIG. 5 is a side elevational view taken in the same direction as FIG. 3 but illustrating the four bar hinge of the invention in its open position rather than its closed position.

As illustrated in FIGS. 3–5, the adjuster member 40 includes a first end 64 having a pivotal connection 66 that mounts the adjuster member on the vehicle body mounted first hinge member 28. Adjuster member 40 also includes a second end 68 at which the one end 54 of the second connection member 52 has its pivotal connection 58 to the adjuster member. The adjuster 38 also includes a threaded connection 70 that extends between the first hinge member 28 and the adjuster member 40 to vertically position the adjuster member as is hereinafter more fully described in connection with FIG. 6.

As shown in FIGS. 3–5, the adjuster member 40 extends forwardly with respect to the vehicle body from its first pivotally mounted end 64 to its second end 68 that is pivotally connected to the second connection member 52 at its end 54 by the pivotal connection 58. More specifically, the adjuster member 40 includes a vertically extending flange 72 that defines the first and second ends 64 and 68 of the adjuster member. The adjuster member 40 also includes a horizontally extending flange 74 from which the vertical flange 72 extends downwardly, and the threaded connection 70 extends between the first hinge member 28 and the horizontal flange 74 of the adjuster member as it is hereinafter more fully described in connection with FIG. 6.

Figure 6:
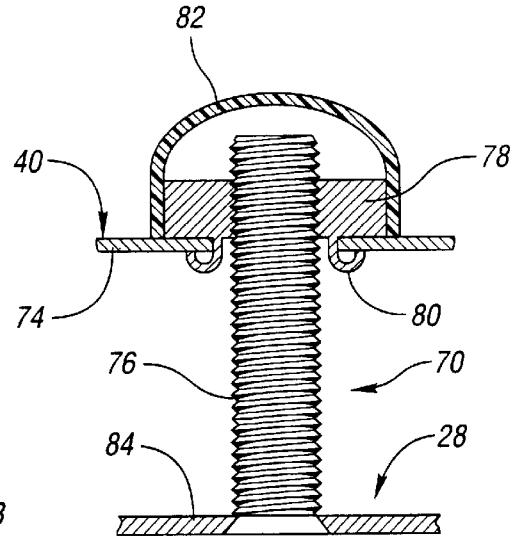
FIG. 6 is a sectional view taken along the direction of line 6—6 in FIG. 3 to illustrate the construction of a threaded connection that adjusts the four bar hinge upon assembly to position the deck lid flush with the rear deck outer skin of the vehicle body.

With reference to FIG. 6, the threaded connection 70 of the adjuster includes a threaded stud 76 whose lower end is fixedly secured to the first hinge member 28 such that the stud projects upwardly from the first hinge member. A nut 78 of the threaded connection 70 is rotatable on the horizontally extending flange 74 of the adjuster member 40 and includes an annular rolled securement flange 80 that retains the nut to the horizontal flange but permits nut rotation upon application of a relatively large adjusting torque. The nut 78 threadingly receives the upwardly projecting stud 76 such that the nut rotation by application of the relatively large adjusting torque provides vertical adjustment of the adjuster member flange 74. After such adjustment, the nut securement flange 80 retains the nut in its adjusted position. Such threaded adjustment of the nut 78 moves the adjusting member 40 vertically and, as illustrated in FIG. 3, this vertical adjustment moves the second connection member 52 vertically so as to vertically move the deck lid 26 vertically to position its outer panel 36 flush with the rear deck outer skin 16 both at its rear deck panel 20 illustrated and at the rear quarter panels previously described. The threaded connection has an elastomeric cap 82 that is mounted over the nut 78 to provide a finished appearance.

Upon assembly of the deck lid 26 to the vehicle body 12 as shown in FIG. 1, each of the two hinges 24 is adjusted as necessary to provide the flush condition of the deck lid with the rear deck outer skin at each lateral side.

As shown in FIGS. 3 and 5, the first hinge member 28 includes a horizontal flange 84 for mounting of the first hinge member on the vehicle body. In addition, the first hinge member includes a vertical flange 86 that extends upwardly from the horizontal flange 84. The pivotal connection 48 of the first connection member 48 to the first hinge member 28 is at its vertical flange 86, and the pivotal connection 66 of the adjuster member 40 to the first hinge member 28 is also at its vertical flange 86. Furthermore, the second hinge member 32 includes a horizontal flange 88 for mounting the deck lid 26 at its inner mounting member 34 previously described, and the second hinge member also includes a vertical flange 90 that extends upwardly from the horizontal flange 88 in the closed hinge position and at which the first and second connection members 42 and 52 have their pivotal connections 50 and 60 to the second hinge member.

With the construction illustrated, the vertical adjustment can be up or down 3 millimeters from a center position for a total vertical adjustment of 6 millimeters. During that extent of vertical adjustment, there is only about 0.1 millimeters of horizontal movement such that the deck lid can be adjusted flush with the outer skin without substantially changing the horizontal spacing between the deck lid and the rear deck outer skin.

While the preferred embodiment of the invention has been described in detail, those familiar with the art to which this invention relates will recognize various alternative embodiments for practicing the invention as defined by the following claims.

What is claimed is:

1. A four bar hinge for mounting a vehicle rear deck lid on a vehicle body for movement between open and closed positions with respect to a generally upwardly oriented rear trunk opening defined in a generally horizontally extending rear deck outer skin of the vehicle body, the four bar hinge comprising:

a first hinge member for mounting on the vehicle body;

a second hinge member for mounting on the deck lid;

one of the hinge members including an adjuster having an adjuster member that has a pivotal connection to the one hinge member, and the adjuster including a threaded connection that extends between the adjuster member and the one hinge member to adjustably move the adjuster member vertically;

a first connection member having opposite ends including respective pivotal connections to the first and second hinge members; and a second connection member having opposite ends one of which has a pivotal connection to the adjuster member of the one hinge member and the other of which has a pivotal connection to the other hinge member to cooperate with the first connection member and the first and second hinge members in providing a four bar linkage that supports the deck lid for movement between the open and closed positions, and the adjuster member of the adjuster being adjustable vertically by the threaded connection upon assembly to move the deck lid vertically so as to be flush with the rear deck outer skin.

2. A vehicle rear deck lid four bar hinge as in claim 1 wherein the one hinge member including the adjuster is the first hinge member that is mounted on the vehicle body.

3. A vehicle rear deck lid four bar hinge as in claim 2 wherein the adjuster member includes a first end where the pivotal connection of the adjuster member mounts the adjuster member on the vehicle body mounted first hinge member, the adjuster member having a second end at which the one end of the second connection member has its pivotal connection to the adjuster member, and the threaded connection that extends between the first hinge member and the adjuster member at a location between the ends thereof to vertically adjustably position the adjuster member.

4. A vehicle rear deck lid four bar hinge as in claim 3 wherein the adjuster member extends forwardly with respect to the vehicle body from its first pivotally mounted end to its second end that is pivotally connected to the second connection member.

5. A vehicle rear deck lid four bar hinge as in claim 4 wherein the adjuster member includes a vertically extending flange that defines the first and second ends, and the adjuster member including a horizontally extending flange that extends from the vertically extending flange and at which the threaded connection is connected to the adjuster member between its first and second ends.

6. A vehicle rear deck lid four bar hinge as in claim 5 wherein the threaded connection of the adjuster includes a threaded stud that projects upwardly from the first hinge member and also includes a threaded nut that is rotatable on the horizontally extending flange of the adjuster member and that threading receives the threaded stud such that the nut rotation vertically adjusts the adjuster member and the deck lid.

7. A vehicle rear deck lid four bar hinge as in claim 1 wherein the first hinge member is the one having the adjuster and includes a horizontal flange for mounting thereof on the vehicle body as well as including a vertical flange, the pivotal connection of the first connection member to the first hinge member being at the vertical flange of the first hinge member, the adjuster member including a pivotal connection to the vertical flange of the first hinge member, and the second hinge member including a horizontal flange for mounting the deck lid as well as including a vertical flange at which the first and second connection members have their pivotal connections to the second hinge member.

8. A vehicle rear deck lid four bar hinge as in claim 7 wherein the adjuster member includes a horizontal flange and a vertical flange that extends downwardly from the horizontal flange, the pivotal connection of the adjuster member to the vertical flange of the first hinge member being at the vertical flange of the adjuster member, and the adjuster including a threaded connection that extends between the horizontal flange of the first hinge member and the horizontal flange of the adjuster member to provide threaded adjusting of the adjuster member so as to move the deck lid flush with the rear deck outer skin.

9. A vehicle rear deck lid four bar hinge as in claim 8 wherein the vertical flange of the adjuster member has opposite ends at which are respectively located the pivotal connection to the vertical flange of the first hinge member and the pivotal connection to the second connection member.

10. A four bar hinge for mounting a vehicle rear deck lid on a vehicle body for movement between open and closed positions with respect to a generally upwardly oriented rear trunk opening defined in a generally horizontally extending rear deck outer skin of the vehicle body, the four bar hinge comprising:

a first hinge member for mounting on the vehicle body;

a second hinge member for mounting on the deck lid;

one of the hinge members including an adjuster having an adjuster member, the adjuster member having a pivotal connection to the one hinge member, and the adjuster including a threaded connection that extends between the one hinge member and the adjuster member to adjustably position the adjuster member vertically about the pivotal connection thereof to the one hinge member;

a first connection member having opposite ends including respective pivotal connections to the first and second hinge members; and a second connection member having opposite ends one of which has a pivotal connection to the adjuster member of the one hinge member and the other of which has a pivotal connection to the other hinge member to cooperate with the first connection member and the first and second hinge members in providing a four bar linkage that supports the deck lid for movement between the open and closed positions, and the adjuster member of the adjuster being adjustable upon assembly by threading of the threaded connection to move the deck lid vertically so as to be flush with the rear deck outer skin.

11. A four bar hinge for mounting a vehicle rear deck lid on a vehicle body for movement between open and closed positions with respect to a generally upwardly oriented rear trunk opening defined in a generally horizontally extending rear deck outer skin of the vehicle body, the four bar hinge comprising:

a first hinge member for mounting on the vehicle body and including an adjuster having an adjuster member, a pivotal connection that supports the adjuster member on the first hinge member and the adjuster including a threaded connection that extends between the first hinge member and the adjuster member to adjustably position the adjuster member vertically about the pivotal connection thereof to the first hinge member;

a second hinge member for mounting on the deck lid;

a first connection member having opposite ends including respective pivotal connections to the first and second hinge members; and a second connection member having opposite ends one of which has a pivotal connection to the adjuster member of the first hinge member and the other of which has a pivotal connection to the second hinge member to cooperate with the first connection member and the first and second hinge members in providing a four bar linkage that supports the deck lid for movement between the open and closed positions, and the adjuster member of the adjuster being adjustable upon assembly by threading of the threaded connection to move the deck lid vertically so as to be flush with the rear deck outer skin.

12. A four bar hinge for mounting a vehicle rear deck lid on a vehicle body for movement between open and closed positions with respect to a generally upwardly oriented rear trunk opening defined in a generally horizontally extending rear deck outer skin of the vehicle body, the four bar hinge comprising:

a first hinge member having a horizontal flange for mounting on the vehicle body and also having a vertical flange that extends upwardly from the horizontal flange, the first hinge member having an adjuster including an adjuster member, the adjuster member having a vertical flange that includes a pivotal connection to the vertical flange of the first hinge member, the adjuster member also including a horizontal flange that extends from its vertical flange, and the adjuster including a threaded connection that extends between the horizontal flange of the first hinge member and the horizontal flange of the adjuster member to adjustably position the adjuster member vertically about the pivotal connection thereof to the vertical flange of the first hinge member;

a second hinge member having a horizontal flange for mounting on the deck lid, and the second hinge member also having a vertical flange that extends upwardly from its horizontal flange;

a first connection member having opposite ends including respective pivotal connections to the vertical flanges of the first and second hinge members; and a second connection member having opposite ends one of which has a pivotal connection to the vertical flange of the adjuster member and the other of which has a pivotal connection to the vertical flange of the second hinge member to cooperate with the first connection member and the first and second hinge members in providing a four bar linkage that supports the deck lid for movement between the open and closed positions, and the adjuster member of the adjuster being adjustable upon assembly by threading of the threaded connection to move the deck lid vertically so as to be flush with the rear deck outer skin.

* * * * *